US008317242B2

(12) United States Patent
Yu

(10) Patent No.: US 8,317,242 B2
(45) Date of Patent: Nov. 27, 2012

(54) TOOL HOLDING GRIP ASSIST

(76) Inventor: David Chen Yu, Laguna Niguel, CA (US)

( * ) Notice: Subject to any disclaimer, the term of this patent is extended or adjusted under 35 U.S.C. 154(b) by 47 days.

(21) Appl. No.: 13/071,259

(22) Filed: Mar. 24, 2011

(65) Prior Publication Data

US 2012/0242098 A1 Sep. 27, 2012

(51) Int. Cl.
*B65G 7/12* (2006.01)

(52) U.S. Cl. ..... 294/25; 2/161.5

(58) Field of Classification Search ..... 294/25, 294/150; 482/49, 139; 42/71.01; 2/16, 20, 2/161.1, 161.6, 163, 161.5; 224/218, 219, 224/221; 30/297, 298
See application file for complete search history.

(56) References Cited

U.S. PATENT DOCUMENTS

| | | | | | |
|---|---|---|---|---|---|
| 774,143 | A | * | 11/1904 | Adams | 224/220 |
| D305,961 | S | * | 2/1990 | Cobb | D3/228 |
| 5,356,371 | A | * | 10/1994 | Hubbard | 602/22 |
| 5,553,324 | A | * | 9/1996 | Emerson | 2/158 |
| 5,957,515 | A | * | 9/1999 | Van Der Sluys | 294/25 |
| 6,678,986 | B2 | * | 1/2004 | Roush | 42/94 |

* cited by examiner

*Primary Examiner* — Dean Kramer
*Assistant Examiner* — Stephen Vu
(74) *Attorney, Agent, or Firm* — Tran & Associates

(57) ABSTRACT

Apparatus and method for holding tools securely with a grip assist are provided. A preferred grip assist preferably includes a wristband having a strap and buckle, a first strap attached to the wristband with a hinge. The first strap also has a ring attached to an end of the strap opposite the hinge. Behind the ring on the first strap, is a first segment of a two segment closure system. A second strap is also attached to the wristband with a second hinge. The second strap has a second segment of the two segment closure system attached to an end opposite the wristband. The two segment closure system is closed to form a grip assist position. The second strap can be held open by a secondary two segment closure system to form an open position.

3 Claims, 4 Drawing Sheets

TOOL HOLDING GRIP ASSIST

BACKGROUND

1. Field

The present disclosure relates generally to tools and their use, and, in particular, to an apparatus and method for holding tools securely with a grip assist.

2. Background

The construction industry has seen the arrival of many electrical and other specialty tools. These tools offer the ability to perform construction tasks, such as cutting or nailing using more power. In addition, the power tools provide quicker and more precise operations. Nail guns give the contractor the ability to install more nails in a given period of time than could be placed by hand with a hammer. Greater uniformity of pressure and correct placement are facilitated with a nail gun. Similarly, an electric saw is much faster than a hand saw. When used correctly these tools can significantly speed up many common construction tasks.

The benefit of these tools is not without cost, however. Because the tools often incorporate electric motors or pneumatic apparatus, these tools are heavier. Often the user must be aware of a power cord and must maneuver the cord to perform operations. For ease of operation, many tools are designed to be held and operated with just one hand. No matter how well designed the power tool; in general, power tools are much heavier than their traditional counterparts.

The heavier weight of power tools may lead to fatigue in the user's hands. Given the increase in weight, it is possible that a user may lose his or her grip on a tool, which may result in poor workmanship, or an accident. The weight of power tools also requires that a user maintain a clear focus while holding, using, and manipulating the tools. Even if fatigue is not a problem, a distracted user could easily lose control of a power tool and injure himself or others nearby.

The injuries caused by power tools may range from simple bruises from a dropped tool, up to severe cuts and lacerations from grip loss on a power saw. There is a need in the art for a grip assist device to aid a user in retaining and controlling a power tool or other device.

SUMMARY OF THE INVENTION

The present disclosure relates generally to tools and their use, and, in particular, to an apparatus and method for holding tools securely with a grip assist. A preferred grip assist preferably includes a wristband having a strap and buckle, a first strap attached to the wristband with a hinge. The first strap also has a ring attached to an end of the strap opposite the hinge. Behind the ring on the first strap, is a first segment of a two segment closure system. A second strap is also attached to the wristband with a second hinge. The second strap has a second segment of the two segment closure system attached to an end opposite the wristband. The two segment closure system is closed to form a grip assist position. The second strap can be held open by a secondary two segment closure system to form an open position.

DETAILED DESCRIPTION OF PREFERRED EMBODIMENTS

Figure 1:
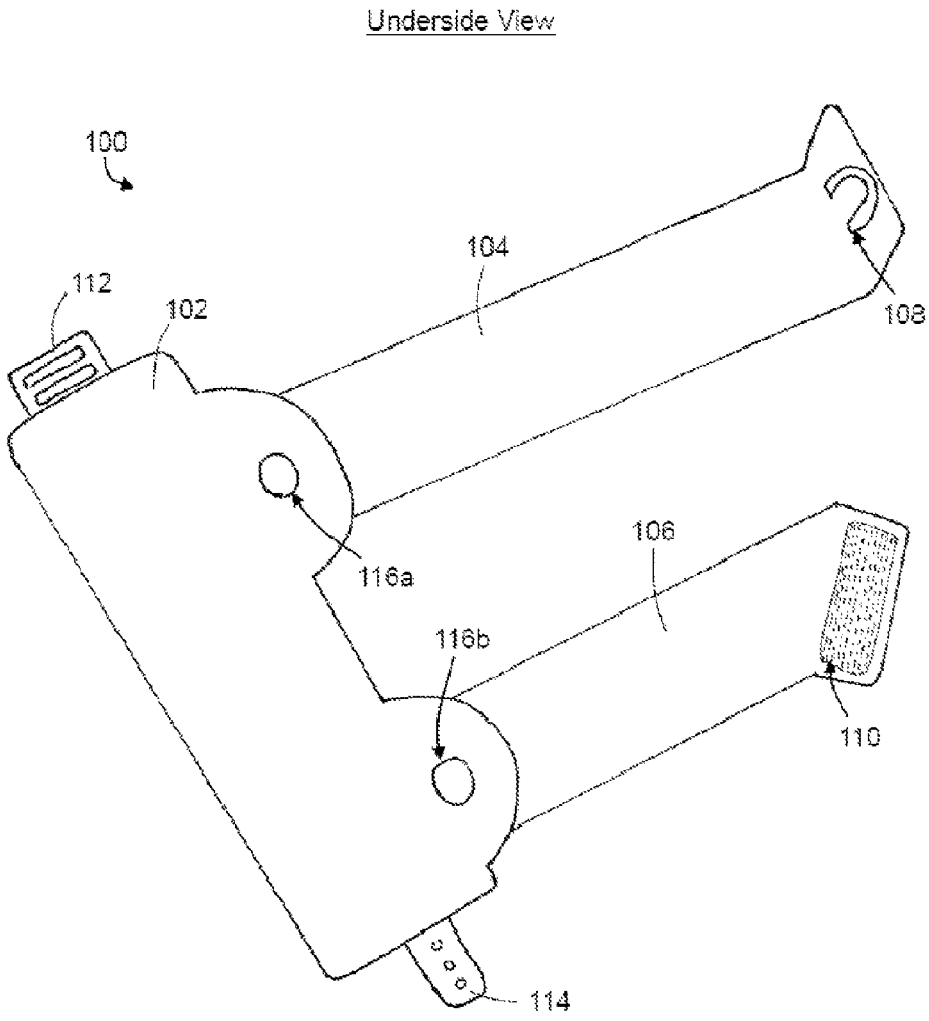
FIG. 1 is an illustration of the underside view of a tool holding grip assist, in accordance with various embodiments of the present invention.

Various embodiments are now described with reference to the drawings, wherein like reference numerals are used to refer to like elements throughout. In the following description, for purposes of explanation, numerous specific details are set forth in order to provide a thorough understanding of one or more embodiments. It may be evident, however, that such embodiment(s) may be practiced without these specific details. In other instances, well-known structures and devices are shown in block diagram form in order to facilitate describing one or more embodiments.

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

Figure 3:
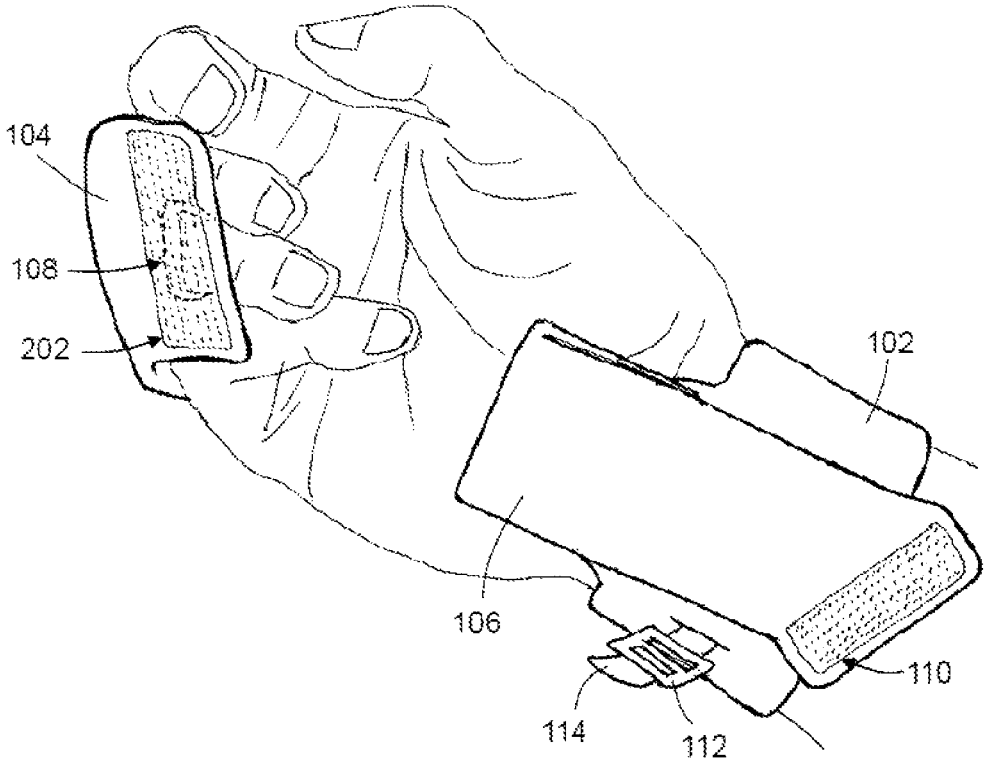
FIG. 3 is an illustration of a tool holding grip assist in use, according to one or more embodiments of the present invention.

Referring to FIG. 1, a tool holding grip assist device 100, according to one embodiment is illustrated. FIG. 1 shows the underside of the tool holding grip assist 100. The tool holding grip assist 100 shown in FIG. 1 includes a wristband 102 having closure means. For example, in FIG. 1, a strap 114 is attached to one end and a buckle 112 attached to the opposite end. The strap 114 and buckle 112 can be used to close the wristband 102 conventionally. Straps 104 and 106 are attached to wristband 102 with hinges 116*a* and 116*b*. Hinges 116*a* and 116*b* allow the up and down movement of the wearer's wrist to occur naturally without constriction or hindrance. Straps 104 and 106 may be of a length suitable for an individual user. Strap 104 has ring 108 attached at the free end of strap 104, opposite hinge 116*a*. Ring 108 is worn on the annular finger as illustrated in FIG. 3. Ring 108 assists in allowing flap 104 to move with the finger, especially when not in a locked position. Strap 106 has one segment of a two segment closure attached to the end opposite hinge 116*b*. The two segment closure may be fabric hook and loop closure fabric, or any other suitable two segment closure system. The two segment closure element 110 mates with the other segment of the closure system 202, which is attached to the other side of the tool holding grip assist.

Figure 2:
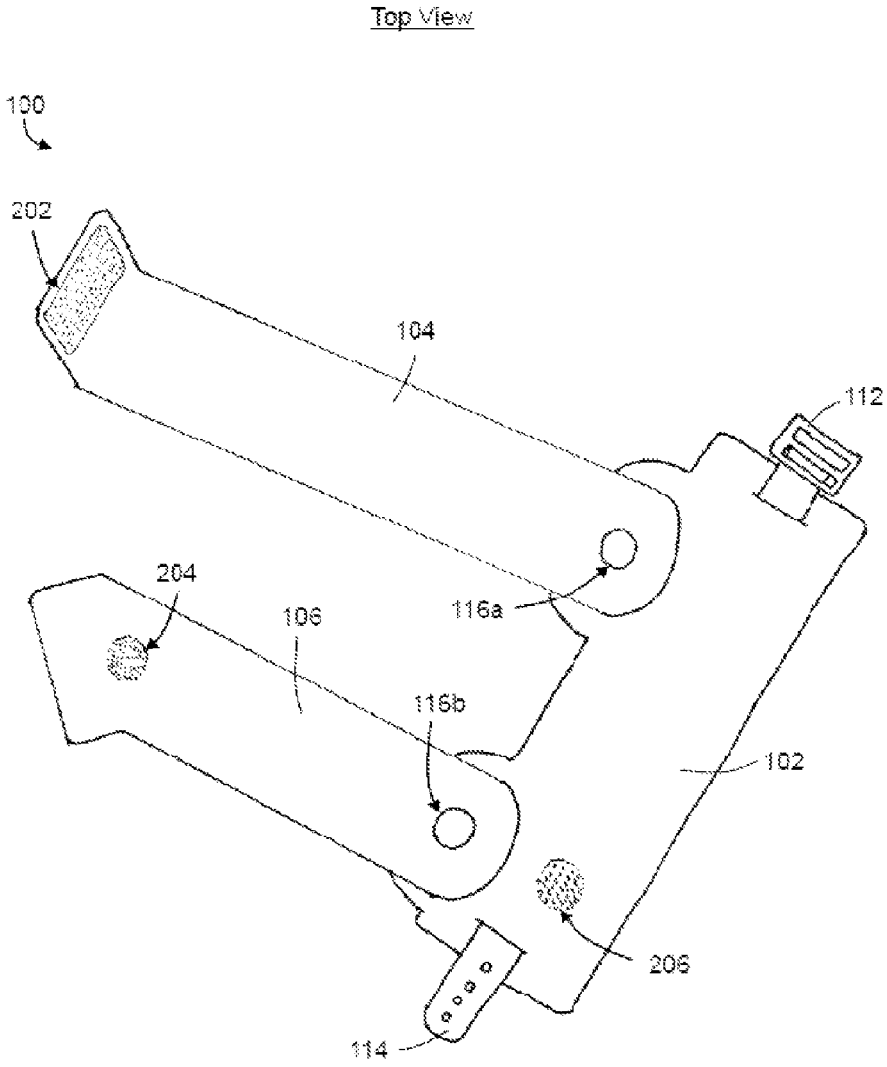
FIG. 2 is an illustration of the top view of a tool holding grip assist, in accordance with one or more embodiments the present invention.

FIG. 2 illustrates the top view of the tool holding grip assist 100. The top view of strap 104 has a segment 202 of a two segment closure system at the end of strap 104. Similarly, strap 106 also has a segment 204 of a two segment closure system located at or near the end of strap 106. These segments of the two segment closure system may be rectangular or round as illustrated in FIG. 2, however, other shapes may be used. An additional segment 206 of a two segment closure system is placed on wristband 102 in line with segment 204. The placement of the segments of the two segment closure system may be adjusted to suit the size of the user's hand.

FIG. 3 illustrates use of the tool holding grip assist. The user puts on the wristband 102 and fastens strap 114 and buckle 112. Ring 108 is fitted over the annular or ring finger. Strap 106 rests on the underside of the user's wrist. Segment 204 is closed with segment 206 to keep the strap 106 away from the palm, while strap 104 crosses the back of the user's hand. Segment 202 attached to strap 104 is closed with segment 110 on strap 106, as shown in FIG. 4.

Once the grip on the tool has been formed the wearer has a secure hold on the tool. The wearer may even relax the grip of his or her muscles and the tool holding grip assist will retain the hold within the tool holding grip assist 100.

The wearer may break the grip established by the tool holding grip assist by grasping the strap 106 and separating segment 202 from segment 110 on strap 104.

Figure 4:
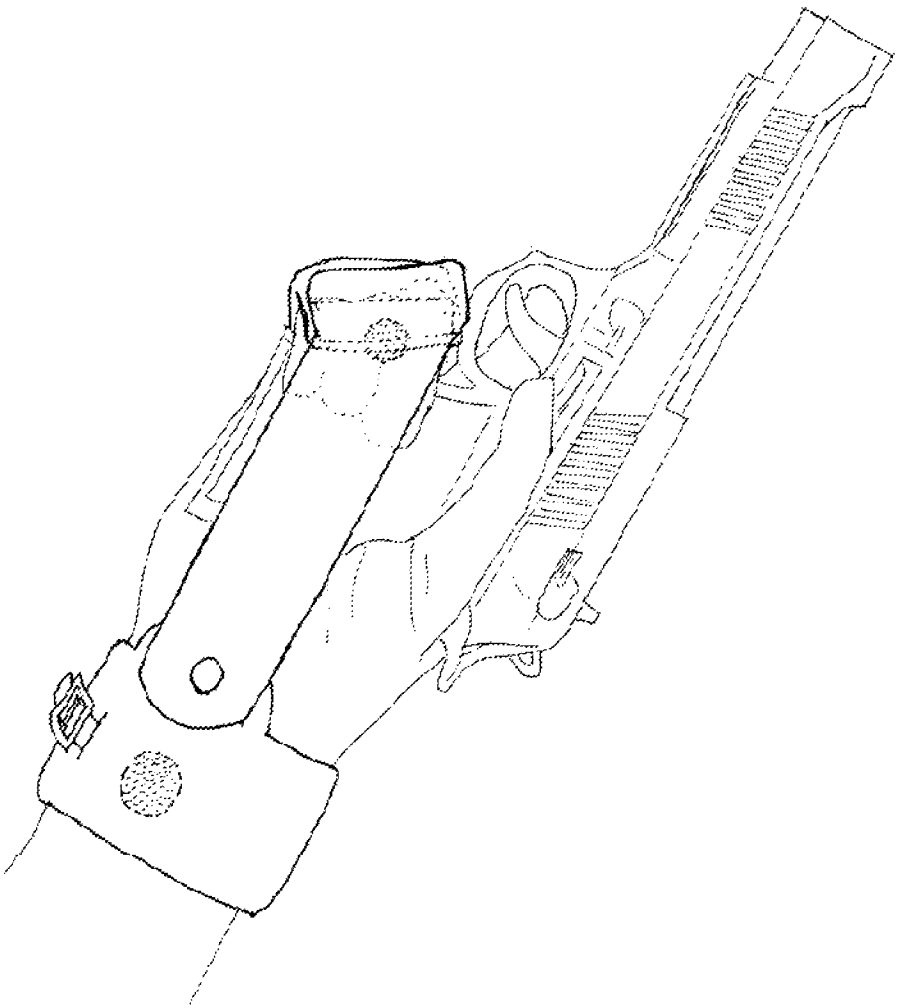
FIG. 4 is an illustration of a tool holding grip assist incorporating a flap holder, in use holding a pistol, in accordance with a further embodiment of the invention

FIG. 4 illustrates a further embodiment in use, with the tool holding grip assist holding a pistol. The illustration depicts the tool holding grip assist with the flaps in the closed position. The two segment closure system holds the two flaps together. The thumb and index fingers are free to operate the pistol. The hinges where the straps attach to the wristband allow the wrist to move up and down as needed. An additional segment of the two segment closure system may be provided on the wristband. This segment allows the strap on the underside of the hand to be secured out of the way when the user is not holding a tool.

While various embodiments of the present invention have been described above, it should be understood that they have been presented by way of example only, and not of limitation. Likewise, the various diagrams may depict an example architectural or other configuration for the invention, which is done to aid in understanding the features and functionality that may be included in the invention. The invention is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the present invention. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A grip assist for holding a tool by a user's hand having a palm side and a back side, comprising:

a wristband to be secured on a wrist of a user, wherein the wrist band defining a longitudinal axis and further having first and second mounting points thereon;

a first strap having a first end hingedly coupled to the first mounting point and a second end with an attachment region facing away from the back side of the user's hand, wherein the first end has a ring attached on an opposite side to the attachment region;

a second strap having a first end hingedly coupled to the second mounting point and a second end secured to the attachment region of the first strap, the second strap when worn covers a portion of the palm side and holds one or more fingers curled into the palm side while providing freedom for a thumb and an index finger to operate the tool, while the ring may be fitted over a user's finger;

wherein the first strap and second strap each being independently pivotable relative to the longitudinal axis of the wristband; and the second strap further comprising a first closure segment attachable to a second closure segment on the wristband in order to hold the second end of the strap to the wristband.

2. A method for holding a tool with a user's hand having a palm side and a back side and with a wristband to be secured on a wrist of a user, the wrist band defining a longitudinal axis and further having first and second mounting points thereon; a first strap having a first end hingedly coupled to the first mounting point and a second end with an attachment region facing away from the back side of the user's hand, wherein the first end has a ring attached on an opposite side to the attachment region; and a second strap having a first end hingedly coupled to the second mounting point and a second end secured to the attachment region of the first strap, the second strap when worn covers a portion of the palm side and holds one or more fingers tucked into the palm side while providing freedom for a thumb and an index finger to operate the tool and the ring to be fitted over an annular finger or a ring finger, comprising:

grasping the tool;

covering one or more fingers on the back side with the first strap; covering one or more fingers on the palm side with the second strap; and securing the first and second straps together at the attachment region;

wherein the first strap and second strap each being independently pivotable relative to the longitudinal axis of the wristband; and the second strap further comprising a first closure segment attachable to a second closure segment on the wristband in order to hold the second end of the strap to the wristband.

3. An apparatus for holding a tool by a user's hand having a palm side and a back side, comprising: means for attaching a wristband defining a longitudinal axis to a user; means for securing a first strap to a user's finger; and means for securing a first strap and a second strap together using a two segment closure system including a wristband to be secured on a wrist, the wrist band having first and second mounting points thereon; a first strap having a first end hingedly coupled to the first mounting point and a second end with an attachment region, the first strap when worn covers a plurality of fingers on the backside; and a second strap having a first end hingedly coupled to the second mounting point and a second end secured to the attachment region of the first strap, the second strap when worn covers a portion of the palm side and holds the fingers in a curled position to securely hold the tool while providing freedom for a thumb and an index finger to operate the tool; wherein the first end of the first strap has a ring attached on an opposite side to the attachment region of the first strap and the ring fitted over an annular finger or a ring finger; and wherein the first strap and second strap each being independently pivotable relative to the longitudinal axis of the wristband; and the second strap further comprising a first closure segment attachable to a second closure segment on the wristband in order to hold the second end of the strap to the wristband.

* * * * *